US005958143A

United States Patent [19]

Weber et al.

[11] Patent Number: 5,958,143

[45] Date of Patent: Sep. 28, 1999

[54] CLEANING PROCESS FOR EUV OPTICAL SUBSTRATES

[75] Inventors: Frank J. Weber, Sunol, Calif.; Eberhard A. Spiller, Mt. Kiso, N.Y.

[73] Assignee: The Regents of the University of California, Oakland, Calif.

[21] Appl. No.: 09/069,491

[22] Filed: Apr. 28, 1998

[51] Int. Cl.[6] ..... B08B 3/12

[52] U.S. Cl. ..... 134/1; 134/26; 427/164; 427/601

[58] Field of Search ..... 134/1, 26, 31, 134/37; 427/601, 164

[56] References Cited

U.S. PATENT DOCUMENTS

| | | | |
|---|---|---|---|
| 3,071,499 | 1/1963 | Raymond et al. | 134/26 |
| 3,870,551 | 3/1975 | Iwami et al. | 427/601 |
| 3,951,659 | 4/1976 | Abita et al. | 134/26 |
| 4,035,210 | 7/1977 | Ohyoshi et al. | 427/601 |
| 4,353,934 | 10/1982 | Nakashima et al. | 427/601 |
| 5,362,330 | 11/1994 | Preussener et al. | 134/26 |
| 5,840,126 | 11/1998 | Yoshida et al. | 134/26 |

*Primary Examiner*—Jill Warden
*Assistant Examiner*—Saeed T. Chaudhry
*Attorney, Agent, or Firm*—L. E. Carnahan; Daryl S. Grzybicki

[57] ABSTRACT

A cleaning process for surfaces with very demanding cleanliness requirements, such as extreme-ultraviolet (EUV) optical substrates. Proper cleaning of optical substrates prior to applying reflective coatings thereon is very critical in the fabrication of the reflective optics used in EUV lithographic systems, for example. The cleaning process involves ultrasonic cleaning in acetone, methanol, and a pH neutral soap, such as FL-70, followed by rinsing in de-ionized water and drying with dry filtered nitrogen in conjunction with a spin-rinse.

24 Claims, No Drawings

CLEANING PROCESS FOR EUV OPTICAL SUBSTRATES

The United States Government has rights in this invention pursuant to Contract No. W-7405-ENG-48 between the United States Department of Energy and the University of California for the operation of Lawrence Livermore National Laboratory.

BACKGROUND OF THE INVENTION

The present invention relates to cleaning optical elements, particularly to cleaning surfaces having very demanding cleanliness requirements and, more particularly, to cleaning optical substrates prior to coating them with reflective coatings, such as extreme-ultraviolet (EUV) reflective coatings.

Recently, substantial effort has been directed to the development of reflective coatings, such as multilayer reflective coatings deposited on an optical substrate for various applications. Such multilayer structures are of particular technological importance in high-resolution, multiple-reflection imaging systems now being developed for projection lithography. Extreme-ultraviolet (EUV) lithography systems require several high precision optics coated with reflective multilayers. One of the problems in the fabrication of such high precision optics is in the preparation of the optical substrate for deposition of the multilayer thereon. Prior cleaning processes which utilize soap, spin-rinsing and drying have been utilized for optics cleaning. Also, prior cleaning processes which utilize freon or trichlorethylene have been developed which have produced satisfactory results. However, the use of freon or trichlorethylene in manufacturing areas has been restricted or eliminated due to environmental concerns. Thus, there has been a need for a cleaning process for EUV optical substrates, for example, which utilizes environmentally safe materials, but yet are effective in cleaning surfaces with very demanding cleanliness requirements.

The present invention provides a solution to the above-referenced optical surface cleaning by providing a process which satisfies the very demanding cleanliness requirements without the use of either freon or trichlorethylene. The cleaning process of the present invention uses ultrasonic cleaning in acetone, methanol, and a pH neutral soap, such as FL-70 soap, followed by rinsing in de-ionized water and drying with filtered nitrogen in conjunction with a spin-rinse.

SUMMARY OF THE INVENTION

It is an object of the present invention to provide a process for cleaning optical elements.

A further object of the invention is to provide a process for cleaning optical substrates prior to deposition of materials on the substrate.

A further object of the invention is to provide a process for cleaning surfaces with very demanding cleanliness requirements.

Another object of the invention is to provide a cleaning process for extreme-ultraviolet (EUV) optical substrates.

Another object of the invention is to provide a process for cleaning optical substrates prior to applying thereto EUV reflective coatings.

Another object of the invention is to provide a process for cleaning optical surfaces utilizing environmentally safe cleaning materials.

Another object of the invention is to provide a cleaning process which uses neither freon nor trichlorethylene.

Another object of the invention is to provide a cleaning process for optical substrates which involves ultrasonic cleaning in acetone, methanol, and a pH neutral soap.

Another object of the invention is to provide a cleaning process which involves rinsing in de-ionized water and drying with dry filtered inert gas, such as nitrogen, in conjunction with a spin-rinse.

Another object of the invention is to provide a cleaning process for optical elements involving successive immersion of the optical elements in acetone, methanol, and a pH neutral soap, minimizing evaporation time between immersions, and maintaining the optical elements wet during transfer from rinse tank to the spin-rinser.

Other objects and advantages of the cleaning process of the present invention will become apparent from the following description. Basically, the invention involves a cleaning process for optical surfaces, such as optical surfaces with very demanding cleanliness requirements, exemplified by optical substrates prior to coating with EUV reflective coatings. Substrates require high smoothness, thus no roughness or particles can be introduced during the substrate cleaning, since roughness is propagated through the multilayers deposited on the substrate, and thus affects reflectivity. The process of the present invention utilizes materials which are environmentally safe and thus utilizes neither freon nor trichlorethylene. The process uses ultrasonic cleaning by immersion in acetone, methanol, and FL-70 soap (a pH neutral soap). Rinsing is carried out in de-ionized water and drying with dry filtered nitrogen is used in conjunction with a spin-rinse. Care is taken to minimize evaporation time between immersions. Also, the optic elements are kept wet during transfer from the rinse tank to the spinner and maintained wet until after the spinner is in operation and the nitrogen blow-dry started.

Experimental verification of the cleaning process of this invention has established the capability of the process for cleaning surfaces with very demanding cleanliness requirements, such as the optical substrates prior to coating them with EUV reflective coatings.

DETAILED DESCRIPTION OF THE INVENTION

The present invention is directed to a process for cleaning optical elements, particularly optical surfaces with very demanding cleanliness requirements so as to assure that no roughness or particles remain on the cleaned surface. The process is particularly directed to cleaning optical substrates prior to applying extreme-ultraviolet (EUV) coatings on the optical substrate. The process of this invention is carried out without the use of either freon or trichlorethylene and thus eliminates the environmental problems associated with the use of these materials. The process uses ultrasonic cleaning in acetone, methanol, and a pH neutral soap, such as FL-70 produced by Fisher Scientific. Rinsing is carried out in de-ionized water, and drying is carried out with a dry filtered inert gas, such as nitrogen, used in conjunction with a spin-rinse. During the process, care is taken to minimize evaporation time between immersions. During the time the optical elements are transferred from the rinse tank to the rinse-spinier, the optical elements were kept wet with de-ionized water, and such wetting was maintained until after the rinse-spinner was on and the nitrogen blow-dry was started. After cleaning, each optical element was placed in a covered evaporation dish for transport to the deposition facility.

The following is a general description of the cleaning process of the present invention:

1. Providing ultrasonic bath (immersion) equipment.
2. Ultrasonic cleaning of the optical element in acetone for a time period of 5 to 10 minutes.
3. Ultrasonic cleaning of the element in methanol for a time period of 5 to 10 minutes.
4. Ultrasonic cleaning in a pH neutral soap solution (i.e., 50 ml FL-70 soap in 2500 ml de-ionized water) for a time period of 5 to 10 minutes.
5. Rinse in de-ionized water for a period of 2 to 4 hours.
6. Spin-rinse at 1000 to 2000 rpm with de-ionized water for 15 to 20 seconds, immediately followed by a blow-dry with dry filtered nitrogen while the optical element is spinning, the blow-dry being for a time period of 2 to 4 seconds.
7. Placing the cleaned optical element in a covered evaporated or dry container for transport to the deposition facility where the reflective coating is deposited thereon.

The following sets forth a detailed example of the process of the present invention as carried out for experimental verification of its capability for cleaning surfaces with very demanding cleanliness requirements, such as surfaces of optical substrates prior to coating with EUV reflective coatings. In this specific example, the cleaning process was utilized to clean 10X-11 optics (elements) composed of a large (secondary) element and a small (primary) element. The process, as carried out, utilizes three ultrasonic baths filled with acetone, methanol, and an FL-70 soap solution (50 ml soap in 2500 ml de-ionized (DI) water. Other pH neutral soaps may be utilized.

The large (secondary) element was carried on a Fluoroware tray with a handle for immersion during ultrasonic cleaning. The small (primary) element was held by its mounting stem with a Fluoroware clamp for immersion during ultrasonic cleaning. Both elements were oriented such that the surface to be coated was vertical. Care was taken to minimize evaporation time between immersions. Stainless steel holders were used so that each element could be mounted on a spinner (such as a photo-resist spinner) for spin-rinsing. The DI water rinse was done in a DI rinse tank. During the time that each element was transferred from the DI rinse tank to the spinner, the elements were kept wet with a stream of DI water dispensed, for example, from a Teflon squeeze bottle. The spinner was turned on and the DI water stream was maintained for 15 seconds. The nitrogen blow-dry was started before the cessation of the DI water stream, with a dry filtered nitrogen flow. The cleaning process for the 10X-11 optics was as follows:

1. Five minutes ultrasonic cleaning in acetone.
2. Five minutes ultrasonic cleaning in methanol.
3. Five minutes ultrasonic cleaning in FL-70 soap solution.
4. Two hour rinse in DI water.
5. Spin-rinse at 2000 rpm with DI water for 15 seconds, immediately followed by a blow-dry with dry filtered nitrogen while the element is spinning (time period of 2–4 seconds). Other dry inert gases, such as argon, may be used in the blow-dry operation.
6. Place each cleaned optical element in a 150 mm evaporation dish and covered by a 200 mm evaporation dish for transport to the deposition lab.

The process of the present invention enables cleaning of optical surfaces, such as optical substrates prior to applying EUV reflective coatings thereon. The cleaning process is environmentally safe, and can be carried for cleaning any optical surface, particularly surfaces with very demanding cleanliness requirements.

While particular time periods, spin speeds, soap solution composition, nitrogen flows, etc. have been set forth to exemplify and explain the principles of the invention, such are not intended to be limiting. Modifications and changes may become apparent to those skilled in the art, and it is intended that the invention be limited only by the scope of the appended claims.

What is claimed is:

1. A process for cleaning optical surfaces, comprising:

sequential ultrasonic cleaning in acetone, methanol, and a pH neutral soap solution, rinsing in de-ionized water, spin-rinsing, and blow-drying.

2. The process of claim 1, additionally including forming the soap solution from 40 to 60 ml soap and 2000 to 3000 ml de-ionized water.

3. The process of claim 2, wherein the soap solution is composed of about 50 ml soap and about 2500 ml de-ionized water.

4. The process of claim 1, wherein the rinsing in de-ionized water is carried out in a time period of 2 to 4 hours.

5. The process of claim 4, wherein rinsing in de-ionized water is carried out for a time period of up to about 2 hours.

6. The process of claim 1, wherein the spin-rinsing is carried out at an rpm in the range of 1000 to 2000 rpm.

7. The process of claim 6, wherein the spin-rinsing is carried out at about 2000 rpm.

8. The process of claim 1, wherein the ultrasonic cleaning in each of the acetone, methanol, and pH neutral soap solution is carried out for a time period in the range of 5 to 10 minutes.

9. The process of claim 8, wherein the ultrasonic cleaning is carried out for about 5 minutes in each of the acetone, methanol, and pH neutral soap.

10. The process of claim 1, wherein the spin-rinsing is carried out in a time period of 15 to 20 seconds.

11. The process of claim 10, wherein the spin-rinsing is carried out for about 15 seconds.

12. The process of claim 1, wherein the blow-dry is carried out immediately following the spin-rinse.

13. The process of claim 1, wherein the blow-dry is carried out during a latter part of the spin-rinse.

14. The process of claim 1, wherein the blow-dry is carried out with dry filtered inert gas.

15. The process of claim 14, wherein the inert gas is selected from nitrogen and argon.

16. The process of claim 1, additionally including minimizing evaporation time between immersions.

17. The process of claim 1, additionally including maintaining the optical surface wet during transfer from the rinsing in de-ionized water to the spin-rinsing.

18. The process of claim 17, wherein the maintaining of the optical surface wet is carried out by directing de-ionized water thereon.

19. The process of claim 1, additionally including directing de-ionized water onto the optical surface for a time period of 5 to 10 seconds after the spin-rinsing is initiated.

20. The process of claim 19, wherein the blow-drying is initiated prior to cessation of the directing of de-ionized water onto the optical surface.

21. The process of claim 20, wherein the time period for directing water after initiation of spin-rinsing is about 15 seconds, and wherein the blow-drying is carried out with dry filtered nitrogen while the optical surface is spinning.

22. The process of claim 1, additionally including transporting the cleaned optical surface in an evaporation dish to a deposition facility, followed by depositing a reflective coating thereon.

23. The process of claim 1, wherein the ultrasonic cleaning is carried sequentially in acetone, methanol, and a pH neutral soap solution.

24. A process for cleaning surfaces having very demanding cleanliness requirements, comprising:

sequentially immersing and ultrasonically cleaning in acetone, methanol, and a pH neutral soap solution, rinsing in de-ionized water and spin-rinsing with de-ionized water, immediately followed by blow-drying with dry filtered nitrogen while spinning.

* * * * *